US007845515B2

(12) United States Patent
Moody

(10) Patent No.: US 7,845,515 B2
(45) Date of Patent: Dec. 7, 2010

(54) MODIFIED GRAVITY-FEED MULTI-FOLD TOWEL DISPENSER

(75) Inventor: John R. Moody, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 24 days.

(21) Appl. No.: 10/004,823

(22) Filed: Dec. 7, 2001

(65) Prior Publication Data

US 2002/0070228 A1 Jun. 13, 2002

Related U.S. Application Data

(60) Provisional application No. 60/254,591, filed on Dec. 11, 2000.

(51) Int. Cl.
*B65H 3/00* (2006.01)

(52) U.S. Cl. ..... 221/36; 221/47; 221/48; 221/65

(58) Field of Classification Search ..... 221/47, 221/48, 65, 36
See application file for complete search history.

(56) References Cited

U.S. PATENT DOCUMENTS

| | | | | | |
|---|---|---|---|---|---|
| 548,260 | A | * | 10/1895 | Lucas | 221/61 |
| 1,151,064 | A | * | 8/1915 | Swift | 221/63 |
| 1,919,605 | A | * | 7/1933 | Swallo | 221/44 |
| 2,830,728 | A | * | 4/1958 | Krueger et al. | 221/48 |
| 3,134,503 | A | * | 5/1964 | Jones et al. | 221/47 |
| 4,065,028 | A | | 12/1977 | Merila | 221/36 |
| 4,094,442 | A | | 6/1978 | Radek | 221/59 |
| 4,311,252 | A | | 1/1982 | Hope, Jr. et al. | 221/57 |
| 4,343,415 | A | | 8/1982 | Radek | 221/63 |
| 4,678,099 | A | * | 7/1987 | Matsui | 221/48 |
| 4,679,703 | A | | 7/1987 | De Luca | 221/52 |
| 4,838,454 | A | | 6/1989 | Salzmann et al. | 221/57 |
| 4,877,154 | A | * | 10/1989 | Matsui | 221/48 |
| 5,074,430 | A | * | 12/1991 | Roberts | 221/44 |
| 5,090,592 | A | * | 2/1992 | Petterson et al. | 221/55 |
| 5,219,092 | A | * | 6/1993 | Morand | 221/53 |
| 5,322,186 | A | * | 6/1994 | Frazier et al. | 221/44 |

(Continued)

FOREIGN PATENT DOCUMENTS

| | | | | |
|---|---|---|---|---|
| CA | 1023707 | * | 1/1978 | 221/221 |

(Continued)

OTHER PUBLICATIONS

Bobrick Model 363 towel dispenser, Mar. 1981.*

(Continued)

*Primary Examiner*—Patrick Mackey
*Assistant Examiner*—Michael E. Butler
(74) *Attorney, Agent, or Firm*—Joel T. Charlton

(57) ABSTRACT

In a gravity-feed towel dispenser for dispensing C-fold and interfolded towels having a transverse length, L, through an elongated bottom dispensing aperture having a length of L or greater, an adapter plate for securing to the bottom portion of the towel dispenser is configured to abridge the length of the dispensing aperture to a length, L' of from about 80 percent to about 90 percent of the transverse length L of the interfolded towels. In a preferred embodiment the adapter plate is provided with a pair of upwardly inclined terminal portions projecting laterally and upwardly at each end of the adapter plate.

12 Claims, 4 Drawing Sheets

U.S. PATENT DOCUMENTS

| | | | | | |
|---|---|---|---|---|---|
| 5,642,836 | A | * | 7/1997 | Merriweather, Jr. | 221/62 |
| 5,931,339 | A | | 8/1999 | Dodge et al. | 221/45 |
| 5,950,863 | A | | 9/1999 | Schutz et al. | 221/46 |
| 5,975,324 | A | * | 11/1999 | Schmitt | 220/6 |
| 6,003,723 | A | | 12/1999 | Morand | 221/44 |
| D430,764 | S | | 9/2000 | Conran et al. | D6/518 |
| 6,315,155 | B1 | * | 11/2001 | Hubanks et al. | 221/63 |
| 6,334,544 | B1 | * | 1/2002 | Christensen et al. | 221/63 |
| 2002/0074340 | A1 | * | 6/2002 | Phelps | 221/45 |

FOREIGN PATENT DOCUMENTS

| | | | | | |
|---|---|---|---|---|---|
| CA | 2310649 | A1 | | 7/1999 | |
| DE | 835049 | | * | 3/1952 | 221/221 |
| FR | 578651 | | * | 10/1924 | 221/63 |
| FR | 2538695 | | * | 7/1984 | 221/48 |
| WO | WO 97/09918 | | | 3/1997 | |
| WO | WO 98/22009 | | | 5/1998 | |

OTHER PUBLICATIONS

Affidavit on Bobrick Model 363 date.*
Affidavit on Bobrick Model 363 dimensions.*

* cited by examiner

MODIFIED GRAVITY-FEED MULTI-FOLD TOWEL DISPENSER

CLAIM FOR PRIORITY

This non-provisional application claims the benefit of the filing date of U.S. Provisional Patent Application Serial No. 60/254,591, of the same title, filed Dec. 11, 2000.

TECHNICAL FIELD

The present invention relates generally to gravity-feed towel dispensers and more particularly to an insert plate operative to define the dispensing aperture of the towel dispenser in order to alleviate dispensing problems.

BACKGROUND ART

Towel dispensers are known in the art. There is shown, for example, in U.S. Pat. No. 5,931,339 to Dodge et al. a dispenser for individually dispensing paper towels from a stack of interfolded paper towels. The paper towels are received in a housing and dispensed by their ends through a slot in a smooth and generally uninterrupted manner. The slot is formed with a narrow medial portion and a large end portions to release only one paper towel at a time. Moreover, the dispenser resists a user pulling out a punch of paper towels from the dispenser; a problem which is well known in the art.

There is disclosed in U.S. Pat. No. 5,950,863 to Schutz et al. an insert device for a gravity-feed sheet dispenser having a housing for receiving a stack of folded sheets. The insert has an inclined frontal portion and generally operates to restrict the width of the dispenser opening.

U.S. Pat. No. 6,003,723 to Morand discloses a large capacity towel dispenser. The dispenser has a rear wall, side walls and front and rear funnel walls extending to a funnel height between bottom portions of the side walls on opposite sides of a feed slot. There is additionally provided a pair of shelf members projecting downwardly and inwardly from respective ones of the side walls. Each shelf member has a shelf width perpendicular to the rear wall approximately 45 percent of a housing depth between upper extremities of the frontal walls, inward extremities of the shelf members wherein the inward extremities are spaced above the feed slot within the funnel height and spaced apart by a distance of not greater than approximately 90 percent of the stacked width, thereby partially supporting the sheets. Each shelf member has an inwardly facing panel surface that forms a side angle of approximately 45 degrees with the side wall.

SUMMARY OF INVENTION

There is provided in a first aspect of the present invention an adapter plate for modifying a gravity-feed towel dispenser generally configured for dispensing C-fold and interfolded towels having a transverse length, L, through an elongated bottom dispensing aperture. Typically the unmodified dispensing aperture has a dispensing length of L or greater and the towel dispenser includes means for defining a top portion, a front wall, a back wall, and a pair of side walls as well as a bottom portion collectively defining an interior for receiving a stack of C-fold or interfolded towels to be dispensed through the aperture. The bottom portion of the towel dispenser defines the elongated dispensing aperture wherein there is provided in accordance with the invention an adapter plate for securing to the bottom portion of the towel dispenser. The adapter plated is configured to abridge the length of the dispensing aperture to a length L' of from about 80 percent to about 90 percent of the transverse length L of the interfolded towels. In another aspect of the present invention there is provided a gravity-feed towel dispenser for dispensing interfolded towels of a transverse length L through an elongated bottom dispensing aperture including means for defining a top portion, a front wall, a back wall, and a pair of side walls of the towel dispenser as well as means for defining a lower surface about the periphery of the dispensing aperture, thereby defining the aperture. The elongated dispensing aperture is of a transverse length L' of from about 80 percent to about 90 percent of the transverse length L of the interfolded towels. Various features and advantages of the present invention will become apparent from the discussion which follows.

BRIEF DESCRIPTION OF DRAWINGS

The present invention is described in detail below with reference to the various figures wherein like numbers indicate similar parts and wherein.

DETAILED DESCRIPTION

The invention is described in detail below with reference to the various figures for purposes of illustration and exemplification only. Various modifications within the spirit and scope of the present invention, set forth in the appended claims, will be readily apparent to those of skill in the art.

Figure 1:
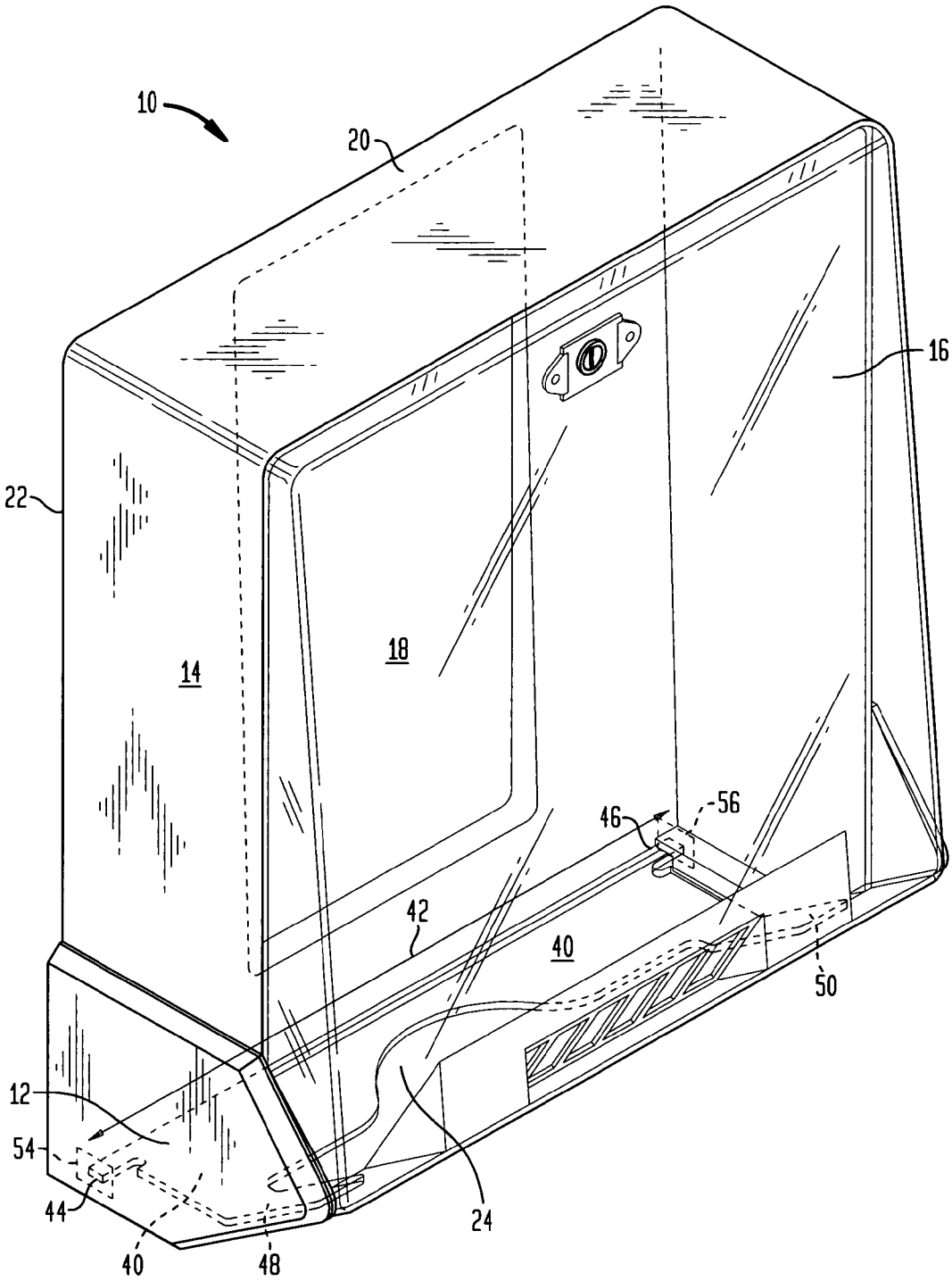
FIG. 1 is a fragmentary view in perspective and elevation of a gravity-feed towel dispenser configured in accordance with the present invention wherein some features are indicated in phantom lines.

Referring to FIG. 1, there is shown a towel dispenser 10, including a bottom portion 12, a first side wall portion 14, and a second side wall portion 16. The towel dispenser further includes a front portion 18, a top portion 20, as well as a back portion 22. The back portion may in some embodiments be partially open or may be continuous. Typically the front, side, top and bottom portions are substantially continuous except for the dispensing aperture generally indicated at 24 throughout the Figures. The towel dispenser may be formed of any suitable material such as sheet metal and the like, although a plastic such as polycarbonate, styrenes and the like are preferred in most embodiments. The various side walls, front portion, top portion and back portion define an interior for receiving a stack of towels. Dispensers of the type in FIG. 1 include an adapter plate in the bottom portion which is utilized depending upon the type of towel to be dispensed. For C-fold towels, the dispensing aperture 24 is relatively large and open, whereas for interfolded towels, it is preferred in accordance with the present invention to restrict the length of the dispensing aperture such that it is shorter than the towels to be dispensed as well as to restrict the width of the aperture. These and other features of the invention will become readily apparent from the discussion which follows.

Figure 2:
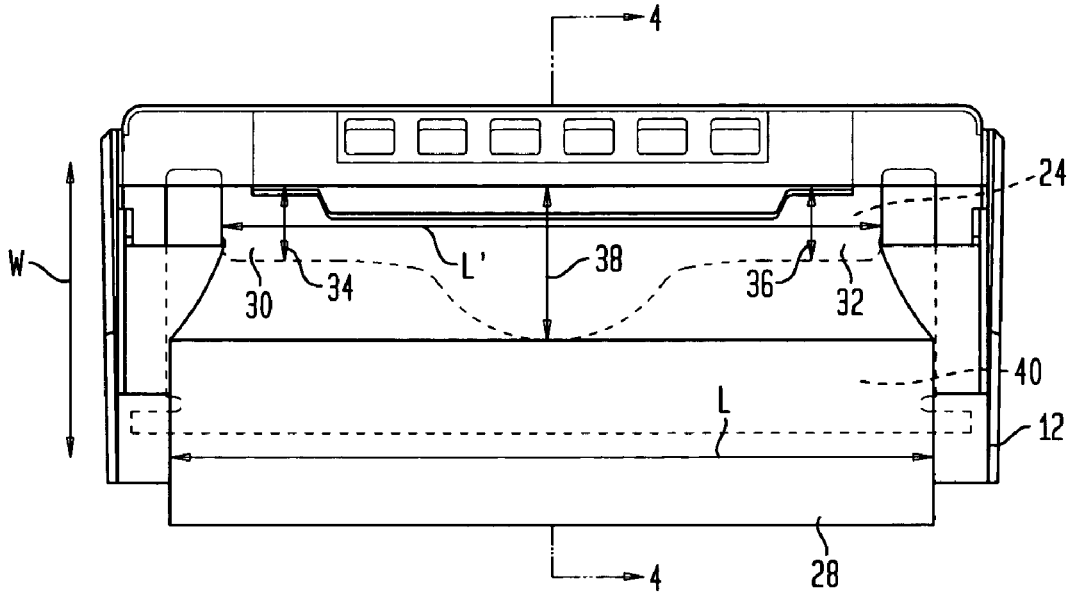
FIG. 2 is a bottom plan view of the towel dispenser of FIG. 1 provided with a stack of multi-fold towels.

There is shown in FIG. 2 a bottom plan view of the towel dispensing of FIG. 1. Of particular interest is the dispensing aperture 24 thereof. Bottom portion 12 includes a plurality of surfaces which define aperture 24 which typically has a transverse length L corresponding roughly with the transverse length L of the paper towels to be dispensed there through. In accordance with the present invention, the transverse length L' of the dispensing aperture is shortened, however, to be of a dimension of from about 80 to about 90 percent of the transverse length L of the paper towels being dispensed through the aperture. For example, for the multi-fold towel shown in FIG. 2, the towel is of a transverse length L to the dispensing direction of about 10½inches. Whereas the multi-fold towel is roughly square, it is folded in three panels of equal length of about 3½inches such that it has a transverse width W to the dispensing direction of about 3½inches as shown in FIGS. 2 and 4. It will be appreciated from FIG. 3 which is a schematic diagram of a prior art dispenser fitted with an adapter plate for dispensing towels that the prior art length L of the aperture corresponds to the length L of the multi-fold towels to be dispensed therethrough.

The invention is further appreciated by reference to FIG. 4 which is a view in elevation and section along lines 4-4 of FIG. 2 showing the towel dispenser of FIG. 1. There is shown in FIG. 4 a stack 26 of multi-fold towels being dispensed through aperture 24. In particular there is shown towel 28 with its tail backward.

Towel 28 has a transverse length L as shown in FIG. 2 of about 10½inches wherein the length L' of the aperture is about 9 inches or roughly about 85 percent of the transverse length of the towel being dispensed. Aperture 24 as shown in FIG. 2 has two terminal portions as indicated at 30 and 32 having a maximum transverse width or span 34,36 of about one inch. The central portion, on the other hand, has a maximum width or span 38 of about 2 inches in the embodiment shown.

Figure 3:
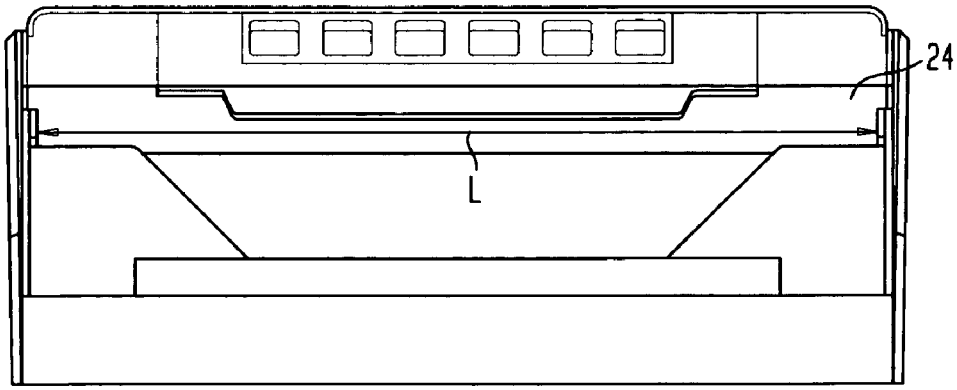
FIG. 3 (PRIOR ART)
FIG. 3 is a bottom view of the towel dispenser of FIG. 1 fitted with a prior art adapter plate for multi-fold towels.
Figure 4:
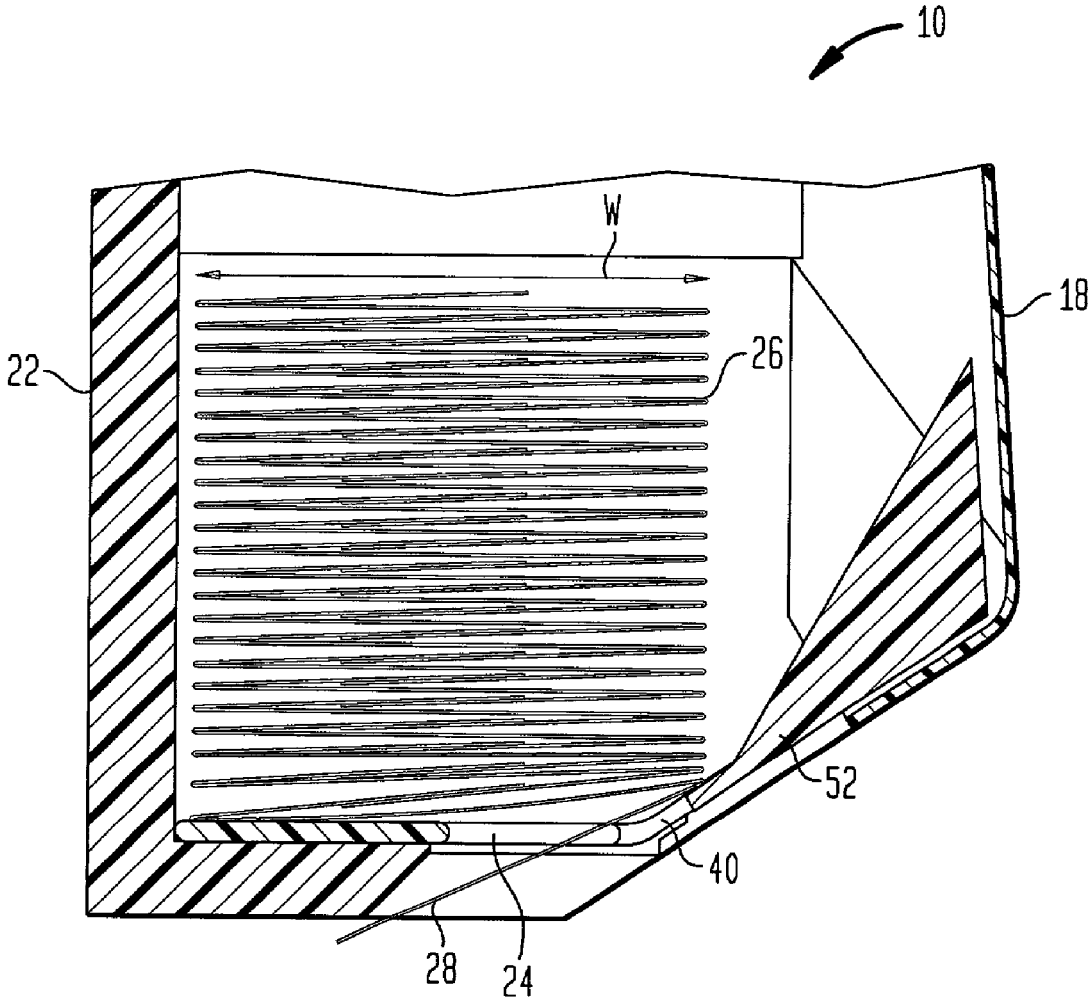
FIG. 4 is a view in elevation and section along lines 4-4 of FIG. 2 showing the vertical profile of the inventive towel dispenser as well as a towel being dispensed there through with the tail backward.

The design will be appreciated as being substantially different from the prior art gravity-feed towel dispenser for multi-fold towels depicted schematically in FIG. 3 wherein the dispensing aperture is of a length L at least as great as the transverse length of the towel to be dispensed therethrough.

From the foregoing discussion it should be appreciated that in one embodiment, the present invention is directed to an adapter plate for fitting into a towel dispenser adapted for dispensing either C-fold or multi-fold towels. Such dispensers are known, for example, and are available from the San Jamar Company as Model No. 566-50. An adapter plate for multi-fold towels generally configures the device to have the geometry shown schematically in FIG. 3. That is to say with an elongated slot of relatively uniform and restricted cross section across the bottom portion of the container.

Figure 6:
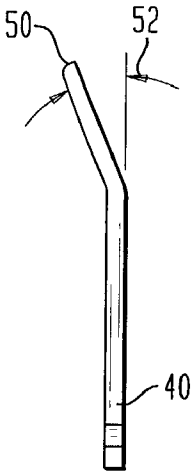
FIG. 6 is an end view of the adapter plate of FIG. 5 showing the upwardly inclined terminal portions thereof.
Figure 5:
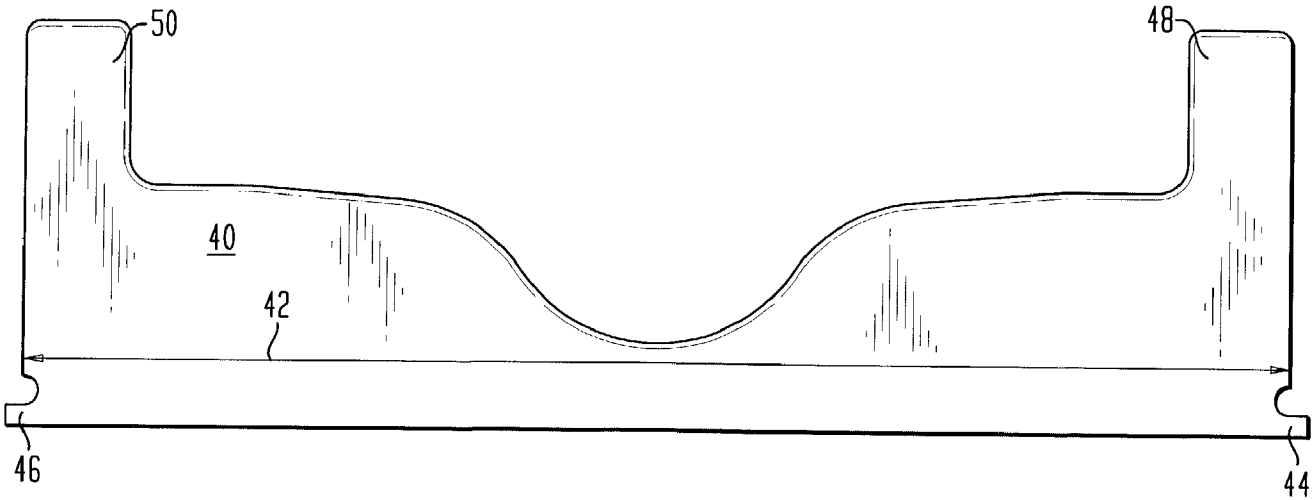
FIG. 5 is a top plan view of the adapter plate fitted in the towel dispenser of FIG. 1.

On the other hand, the present invention is configured in one embodiment to include an adapter plate 40 as shown in FIGS. 1, 2, 4, 5, and 6. The adapter plate is generally of a length 42 commensurate with the bottom portion of the towel dispenser and includes a pair of mounting projections 44,46, adapted to be inserted into slots in the side walls of the towel dispenser in order to pivotally mount the plate therein. In this connection it is noted that the front portion may be pivotally secured to the back portion of the towel dispensers such that the dispenser is moved forwardly to reload the dispenser. It is thus desirable to have the plate 40 be able to pivot and accommodate this procedure. Adaptor plate 40 is further provided with a pair of laterally projecting terminal portions 48,50 which operate to abridge the length of the dispensing aperture when the plate 40 is mounted in the bottom portion of the dispenser as shown in FIGS. 1, 2 and 4. It will be further appreciated that the terminal portions, 48 and 50 are upwardly inclined with respect to the bottom of the dispenser (likewise with respect to the bottom surface of the plate) as shown in FIG. 6. The angle of inclination 52 is preferably about 20 degrees but may be from about 10 to about 30 degrees. Thus the present invention provides a unique configuration for a gravity-feed towel dispenser generally having the characteristics that the transverse length of the dispensing aperture of the towel dispenser is abridged to a length L' of from about 80 to about 90 percent of the transverse length L of interfolded towels to be dispensed there through. In a preferred embodiment there is provided an adapter plate to render a prior art gravity feed towel dispenser to modify the geometry of a prior art gravity-feed towel dispenser to the configuration of the present invention. A particularly preferred adapter plate comprises a pair of upwardly inclined terminal portion which project laterally and upwardly at each end of the adapter plate. The plate is generally elongated and rectangular as shown in FIG. 5. The elongated dispensing aperture in a particularly preferred embodiment is abridged to a length L' of about 85 percent of the transverse length L of the interfolded towels. That is to say, a nine inch aperture length is provided for a 10½ inch towel, for example. The upwardly inclined terminal portions typically have an angle of inclination of anywhere from about 10 to about 30 degrees whereas about 20 degrees is particularly preferred. When the embodiment is an adapter plate for securing to a prior art towel dispenser, the adapter plate is pivotally secured in the housing in slots 54,56, for example, such that it will not interfere with the loading operation. The geometry of the adapter plate is such (as best shown in FIG. 5) that it defines a central enlarged portion of a dispensing aperture and two restricted terminal portions. The central enlarged portion typically has a span of at least about twice the span of the restricted portions of the dispensing aperture. The terminal, or restricted portions of the dispensing aperture have a span of from about 20 to about 40 percent of the transverse width of the interfolded towels. That is to say the restricted portions have a span of about one inch for dispensing a multi-fold towel having a panel width of about 3½ inches. In such geometry, the terminal portions of the aperture have a span of about 30 percent of the transverse width of the interfolded towels. The terminal portions typically extend over at least about 40 percent of the abridged length of the dispensing aperture. That is to say the terminal portions such as terminal portions 30, 32 would extend over at least about 40 percent of the length L' shown in FIG. 2 or about 3½ inches for a nine inch aperture. The gravity-feed towel dispenser shown in FIGS. 1, 2, 4, 5 and 6 are particularly suitable for dispensing multi-fold towels, that is, square towels folded such that the terminal panel is interweaved with the end panel of the proceeding towel as is well known to one of skill in the art. This feature of the invention will be particularly appreciated from the following data wherein dispensing problems were noted over 100's of dispensing attempts.

COMPARATIVE EXAMPLES 1-445

In a first set of trials, a towel dispenser having a prior art configuration of FIG. 2 was loaded with towels and 216 attempts were made to dispense the towels. Dispensing problems were recorded wherein either a) more than one towel came out of the dispenser on a dispensing attempt, or towels fell out of the dispenser during the dispensing attempts. This set of trials was carried out with the towel orientation in the "tail backward" configuration. The number of occurrences with the dispensing problem of more than one towel coming out of the dispenser had an occurrence rate of 1.85 percent. Dispensing problems wherein towels fell out had an occurrence rate of 15.74 percent wherein 85 towels actually fell to the floor.

Following the procedure of Comparative Examples 1 through 216 another 229 attempts were made to dispense the towels in a tail backward configuration from the prior art towel dispenser of FIG. 3. In these trials the percent of occurrence of more than one towel dispensing was 0.87 percent whereas the occurrence rate for towels falling out was 8.3 percent wherein 46 towels fell on the floor. The total percent occurrence of more than one towel coming out for these first two sets of data was 1.35 percent for dispensing more than one towel and 11.91 percent of the time more a towel fell out of the dispenser with a total amount of towels on the floor of 131.

Examples 446-1055

A towel dispenser of the general type utilized in Comparative Examples 1 through 445 was fitted with an adapter plate as shown in FIGS. 5 and 6 hereof. Following the identical procedures of Examples 1 through 445 an additional 610 attempts were made to dispense a towel. There were no occurrences of more than 1 towel (tail backward) coming out of the dispenser and there were also no occurrences of any towels falling out through the dispensing aperture. It was noted that it was difficult to obtain a first towel which of course is not particularly relevant to subsequent dispensing attempts.

Examples 1055-1599

Following generally the procedure of Comparative Examples 1 through 445 a towel dispenser having a configuration shown in FIG. 3 prior art) was tested for dispensing problems in the "tail forward" configuration. Here again dispensing problems of more than one towels, or towels falling out of the dispenser were recorded. The total percent occurrence for this set of trials for dispensing more than one towel was 0.55 percent, whereas dispensing problems wherein a towel fell out of the dispenser had an occurrence rate of 3.12 percent. The total number of towels on the floor for these trials was 32.

Examples 1600-2160

Following the procedure generally of Examples 1056-1599, a dispenser was fitted with a gravity-fed towel dispenser was fitted with the towel dispenser adaptor plate of FIGS. 5 and 6. Dispensing attempts were then made as before in the tail forward configuration for another 560 attempts. In this set of trials there were no dispensing problems where more than one towel dispensed however, there was one occurrence where a towel fell out of the dispenser for a total percent occurrence of 0.18 percent. As will be appreciated from the above, the adapter plate and/or the dispensing configuration of the inventive towel dispenser provides a remarkable improvement in dispensing problems over the prior art.

While the present invention has been described in detail with reference to particular embodiments, modifications thereto within the spirit and scope of the present invention, set forth in the appended claims, will be readily apparent to one of skill in the art.

What is claimed is:

1. A modified gravity-feed towel dispenser for dispensing C-fold and interfolded towels, wherein said dispenser houses C-fold or interfolded towels having a transverse length, L, which are positioned to be dispensed through an elongated bottom dispensing aperture having a length of L or greater, said towel dispenser including means for defining a top portion, a front wall, a back wall and a pair of side walls of said towel dispenser, as well as a bottom portion collectively defining an interior for receiving a stack of C-fold or interfolded towels, said bottom portion of said towel dispenser defining said elongated bottom dispensing aperture, wherein an adapter plate is secured to said bottom portion of said towel dispenser and is configured to abridge the length of said dispensing aperture to a length L' of 80 percent to 90 percent of said transverse length, L, of said C-fold or interfolded towels.

2. The towel dispenser according to claim 1, wherein the adapter plate is an elongate member with a generally planar medial portion and further comprises a pair of terminal portions projecting outwardly and upwardly with respect to the planar medial portion at each end of said adapter plate, such that the terminal portions are upwardly inclined with respect to the medial portion of the plate.

3. The towel dispenser according to claim 2, wherein said elongated dispensing aperture is abridged to a length, L', of 85 percent of the transverse length L of said C-fold or interfolded towels.

4. The towel dispenser according to claim 2, wherein the upwardly inclined terminal portions have an angle of inclination of 10 to 30 degrees with respect to the generally planar medial portion of the adapter plate.

5. The towel dispenser according to claim 4, wherein the upwardly inclined terminal portions have an angle of inclination of 20 degrees with respect to the generally planar medial portion of the adapter plate.

6. The towel dispenser according to claim 2, pivotally secured to the lower portion of said gravity-feed towel dispenser.

7. The towel dispenser according to claim 1, wherein said adapter plate is configured to define a central enlarged portion of the dispensing aperture and two restricted terminal portions of the dispensing aperture each of the portions having a span perpendicular to the length of the dispensing aperture.

8. The towel dispenser according to claim 7, wherein said enlarged central portion has a span of at least twice the span of the restricted terminal portions.

9. The towel dispenser according to claim 8, wherein the terminal portions of the dispensing aperture have a span of 20 to 40 percent of the width of said interfolded towels corresponding thereto.

10. The towel dispenser according to claim 9, wherein said restricted terminal portions of said aperture have a span of 30 percent of the width of said interfolded towels corresponding thereto and a collective length of at least 40 percent of the abridged length L' of said dispensing aperture.

11. In a gravity-feed towel dispenser for dispensing C-fold and interfolded towels, wherein said dispenser contains C-fold or interfolded towels having a transverse length, L, which are positioned to be dispensed through an elongated bottom dispensing aperture having a length of L or greater, said towel dispenser including means for defining a top portion, a front wall, a back wall and a pair of side walls of said towel dispenser, as well as a bottom portion collectively defining an interior for receiving a stack of C-fold or interfolded towels, said bottom portion of said towel dispenser defining said elongated bottom dispensing aperture, said dispenser being of the class that are moved forwardly for reloading; the improvement comprising an adapter plate secured to said bottom portion of said towel dispenser configured to abridge the length of said dispensing aperture to a length L' of 80 percent to 90 percent of said transverse length, L, of said C-fold or interfolded towels, wherein the adapter plate is pivotally secured to the dispenser to accommodate reloading.

12. The improvement according to claim 11, wherein said adapter plate is pivotally secured to the sidewalls of the dispenser.

* * * * *